US009819087B2

(12) United States Patent
Yamagajo et al.

(10) Patent No.: US 9,819,087 B2
(45) Date of Patent: Nov. 14, 2017

(54) PLANAR ANTENNA

(71) Applicants: FUJITSU LIMITED, Kawasaki-shi, Kanagawa (JP); FUJITSU FRONTECH LIMITED, Inagi-shi, Tokyo (JP)

(72) Inventors: Takashi Yamagajo, Yokosuka (JP); Manabu Kai, Yokohama (JP); Masahiko Shimizu, Kawasaki (JP); Yusuke Kawasaki, Inagi (JP)

(73) Assignees: FUJITSU LIMITED, Kawasaki (JP); FUJITSU FRONTECH LIMITED, Tokyo (JP)

( * ) Notice: Subject to any disclaimer, the term of this patent is extended or adjusted under 35 U.S.C. 154(b) by 0 days.

(21) Appl. No.: 15/170,695

(22) Filed: Jun. 1, 2016

(65) Prior Publication Data

US 2017/0005409 A1 Jan. 5, 2017

(30) Foreign Application Priority Data

Jun. 30, 2015 (JP) ..... 2015-131193

(51) Int. Cl.

| | |
|---|---|
| ***H01Q 1/38*** | (2006.01) |
| ***H01Q 9/04*** | (2006.01) |
| ***H01Q 9/28*** | (2006.01) |
| ***H01Q 21/00*** | (2006.01) |
| ***H01Q 21/24*** | (2006.01) |
| *H01Q 1/22* | (2006.01) |

(52) U.S. Cl.
CPC ..... *H01Q 9/0407* (2013.01); *H01Q 9/0457* (2013.01); *H01Q 9/285* (2013.01); *H01Q 21/0075* (2013.01); *H01Q 21/24* (2013.01); *H01Q 1/2216* (2013.01); *H01Q 1/38* (2013.01)

(58) Field of Classification Search
CPC ..... H01Q 9/0407; H01Q 1/38
USPC ..... 343/700 MS
See application file for complete search history.

(56) References Cited

FOREIGN PATENT DOCUMENTS

JP 2014-090291 A 5/2014

*Primary Examiner* — Graham Smith
(74) *Attorney, Agent, or Firm* — Arent Fox LLP

(57) ABSTRACT

A planar antenna includes: first and second conductors each of which forms a microstrip line in combination with a ground electrode, and which are arranged in parallel with each other on a substrate; a plurality of first resonators disposed between the first conductor and the second conductor which electromagnetically couple the first conductor at one longitudinal end of each of the first resonators to generate electric fields which are in phase with each other; and at least one second resonator disposed between the first conductor and the second conductor which electromagnetically couples the second conductor at one longitudinal end of the at least one second resonator to generate an electric field which is in phase with the electric fields generated by the plurality of first resonators, wherein the at least one second resonator is arranged alternately with the plurality of first resonators.

10 Claims, 14 Drawing Sheets

Ex

Ey

PLANAR ANTENNA

CROSS-REFERENCE TO RELATED APPLICATION

This application is based upon and claims the benefit of priority of the prior Japanese Patent Application No. 2015-131193, filed on Jun. 30, 2015, the entire contents of which are incorporated herein by reference.

FIELD

The embodiments discussed herein are related to a planar antenna.

BACKGROUND

Antennas that use microstrip lines as antennas have been proposed in prior art (for example, refer to Japanese Laid-open Patent Publication No. 2014-090291). A multilayered transmission line plate is disclosed, for example, in Japanese Laid-open Patent Publication No. 2014-090291 includes a multilayered plate formed by stacking a first conductive layer, a first dielectric layer, a second conductive layer, a second dielectric layer, and a third conductive layer, one on top of the other in this order, wherein the second conductive layer forms a microstrip line which functions as a feed line. One or more patch conductors are formed on the third conductive layer, and the third conductive layer with such patch conductors formed thereon is disposed so as to partially overlap the second conductive layer when the plane of the multilayered plate is viewed from the top.

SUMMARY

In recent years, radio frequency identification (RFID) systems have come into wide use. In such RFID systems, it is proposed to incorporate an antenna of a tag reader into a shelf on which articles are placed and manage the articles via wireless communication between the tag reader and a wireless tag (hereinafter referred to as an RFID tag) attached to each of the articles placed on the shelf.

An antenna using a microstrip line is being studied for use as the antenna to be incorporated into such a shelf. In this case, in order to be able to communicate with the RFID tag of any article located at any place on the shelf in which the antenna is incorporated, it is preferable that the antenna is configured so as to be able to form a uniform and strong electric field near the surface of the antenna for radio waves having a specific frequency used for the communication.

According to one embodiment, a planar antenna is provided. The planar antenna includes: a substrate which is formed from a dielectric material; a ground electrode which is provided on one surface of the substrate; a first conductor which is provided on the other surface of the substrate, and which forms a microstrip line in combination with the ground electrode; a second conductor which is provided on the other surface of the substrate so as to extend in parallel to the first conductor, and which forms a microstrip line in combination with the ground electrode; a plurality of first resonators disposed between the first conductor and the second conductor which electromagnetically couple the first conductor at one longitudinal end of each of the first resonators to generate, with a current having a predetermined wavelength and flowing through the first conductor, electric fields which are in phase with each other; and at least one second resonator disposed between the first conductor and the second conductor which electromagnetically couples the second conductor at one longitudinal end of the at least one second resonator to generate, with a current having the predetermined wavelength and flowing through the second conductor, an electric field which is in phase with the electric fields generated by the plurality of first resonators, wherein the at least one second resonator is arranged alternately with the plurality of first resonators.

The object and advantages of the invention will be realized and attained by means of the elements and combinations particularly pointed out in the claims.

It is to be understood that both the foregoing general description and the following detailed description are exemplary and explanatory and are not restrictive of the invention, as claimed.

DESCRIPTION OF EMBODIMENTS

Planar antennas according to various embodiments will be described below with reference to the drawings.

The planar antenna described herein includes two parallelly arranged line conductors each of which forms a microstrip line in combination with a ground electrode. One of the two conductors is fed at one end thereof, and is connected at the other end to one end of the other conductor by a connecting conductor having a length equal to an integral multiple of the wavelength of a current corresponding to the radio wave that the planar antenna radiates or receives. Then, between the two parallelly arranged conductors a plurality of resonators each of which is disposed with its longitudinal direction crossing an associated one of the conductors is arranged, and each of which resonates with the associated conductor by electromagnetically coupling the conductor and thereby excites a current having the same wavelength as that of the current flowing through the conductor. The resonators that electromagnetically couple the same conductor are arranged, one spaced apart from another along the conductor by a distance approximately equal to the wavelength of the current flowing through the conductor. Further, the resonators that electromagnetically couple one of the conductors are displaced in position along the conductor with respect to the respective resonators that electromagnetically couple the other conductor by an amount approximately equal to one half of the current flowing through each conductor. More specifically, the resonators that electromagnetically couple one of the conductors and the resonators that electromagnetically couple the other conductor are arranged in alternating and staggered fashion, one spaced apart from another by a distance approximately equal to one half of the wavelength of the current flowing through each conductor. With this structure, the planar antenna improves the uniformity and strength of the electric field near the planar antenna by reducing the spacing between each resonator while maintaining the current flowing between each resonator in phase.

In the embodiments and their modified example described herein, each planar antenna disclosed in this specification is configured, for example, as a shelf antenna which is incorporated in a shelf and which is used to communicate with RFID tags attached to the articles placed on the shelf. However, the planar antennas disclosed in this specification may be used for other purposes than shelf antennas. For example, the planar antennas disclosed in this patent specification need not be limited in use to RFID tag communication, but may be used as various kinds of near-field antennas to be used for communication with other communication devices.

Figure 1:
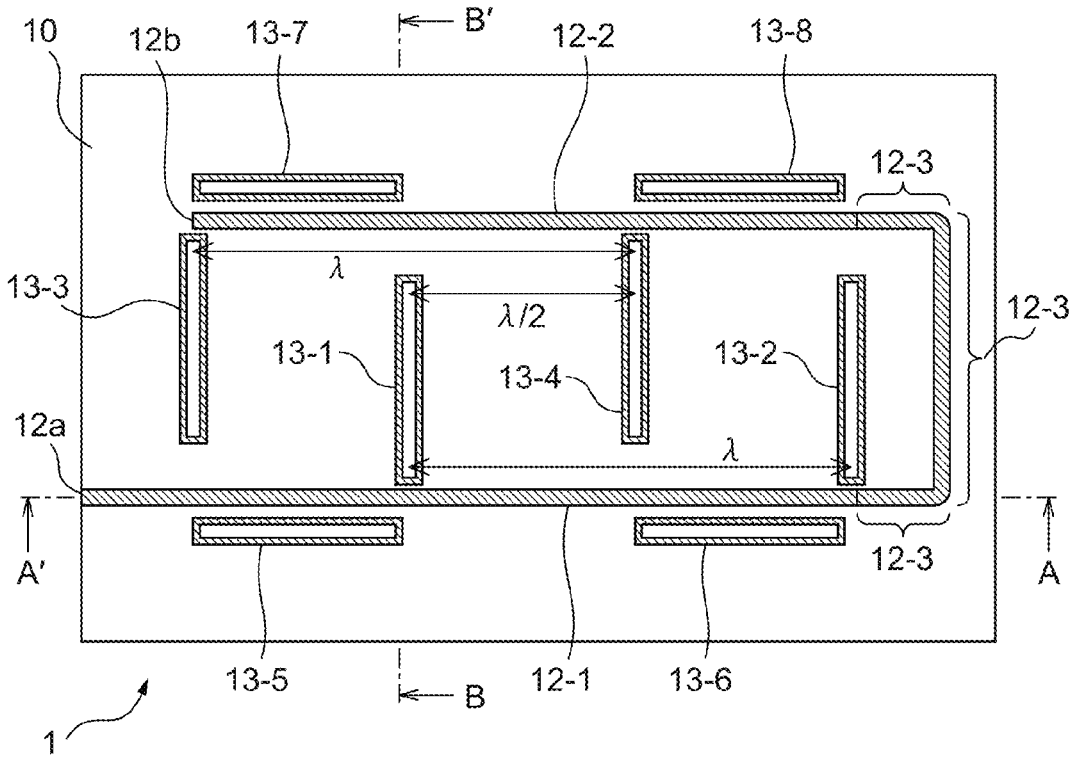
FIG. 1 is a plan view of a shelf antenna according to a first embodiment.
Figure 2A:
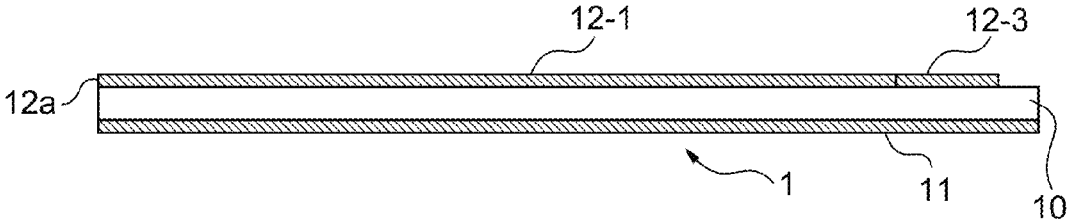
FIG. 2A is a cross-sectional side view of the shelf antenna taken along line AA' in FIG. 1 and viewed in the direction of the arrow.
Figure 2B:
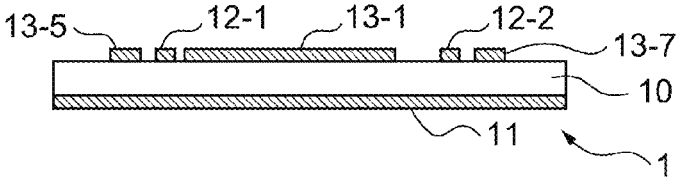
FIG. 2B is a cross-sectional side view of the shelf antenna taken along line BB' in FIG. 1 and viewed in the direction of the arrow.

FIG. 1 is a plan view of a shelf antenna according to a first embodiment, and FIG. 2A is a cross-sectional side view of the shelf antenna taken along line AA' in FIG. 1 and viewed in the direction of the arrow. FIG. 2B is a cross-sectional side view of the shelf antenna taken along line BB' in FIG. 1 and viewed in the direction of the arrow.

The shelf antenna 1 includes a substrate 10, a ground electrode 11 provided on one surface of the substrate 10, line conductors 12-1 to 12-3 provided on the other surface of the substrate 10, and a plurality of resonators 13-1 to 13-8 formed in the same plane as the line conductors 12-1 to 12-3. For convenience of explanation, the surface of the substrate 10 on which the ground electrode 11 is formed will hereinafter be referred to as the lower surface or the back surface, while the surface of the substrate 10 on which the conductors 12 and the plurality of resonators 13-1 to 13-8 are formed will be referred to as the upper surface or the front surface.

The substrate 10 has a planar shape, and supports the ground electrode 11, the conductors 12-1 to 12-3, and the resonators 13-1 to 13-8. The substrate 10 is formed from a dielectric material, so that the ground electrode 11 is insulated from the conductors 12-1 to 12-3 and the resonators 13-1 to 13-8. The substrate 10 is formed, for example, from a glass epoxy resin such as FR-4. Alternatively, the substrate 10 may be formed from some other dielectric material that can be formed in a layered structure. Further, the thickness of the substrate 10 is chosen so that the characteristic impedance of the shelf antenna 1 becomes equal to a predetermined value, for example, 50Ω or 75Ω.

The ground electrode 11, the conductors 12-1 to 12-3, and the resonators 13-1 to 13-8 are each formed, for example, from a metal such as copper, gold, silver, or nickel or an alloy thereof or from some other suitable conductive material. Then, the ground electrode 11, the conductors 12-1 to 12-3, and the resonators 13-1 to 13-8 are fixed to the back surface or front surface of the substrate 10, for example, by etching or by adhesive.

The ground electrode 11 is a grounded planar conductor, and is formed, for example, so as to cover the entire back surface of the substrate 10.

The conductors 12-1 to 12-3 are line conductors formed on the front surface of the substrate 10. Of these conductors, the conductors 12-1 and 12-2 are arranged parallel to each other along the longitudinal direction of the substrate 10. Further, the conductors 12-1 and 12-2 are spaced from each other by a distance longer than one half of the design wavelength so that the resonators 13-1 to 13-4 can be disposed therebetween. One end of the conductor 12-1 is a feed point 12*a* at which the conductor 12-1 is connected to a communication circuit (not depicted) which processes radio frequency signals received or to be radiated via the shelf antenna 1. The other end of the conductor 12-1 is connected to one end of the conductor 12-3. The other end of the conductor 12-3 is connected to one end of the conductor 12-2, the one end being the end nearer to the other end of the conductor 12-1. In other words, the one end of the conductor 12-2 is located at the same position as the other end of the conductor 12-1 when viewed across the longitudinal direction of the substrate 10. The other end of the conductor 12-2, i.e., the end point 12*b* nearer to the feed point 12*a*, is an open end. The conductors 12-1 to 12-3 may each be formed as a portion of a single U-shaped line conductor whose one end is the feed point 12*a* and whose other end is the open end 12*b*. Each of the conductors 12-1 to 12-3 forms, in combination with the ground electrode 11, a microstrip line which is one example of a distributed constant transmission line. As a result, each of the conductors 12-1 to 12-3, in combination with the ground electrode 11 and the substrate 10, operates as a microstrip line antenna.

Since the end point 12*b* of the conductor 12-3 is an open end, the current flowing through the conductors 12-1 to 12-3 due to the radio wave received or to be radiated by the shelf antenna 1 results in the production of a standing wave. As a result, the nodes of the standing wave are formed at every position located away from the open end 12*b* by an integral multiple of one half wavelength of the radio wave or the current. It is to be noted that since the conductors 12-1 to 12-3 are formed on the upper surface of the dielectric substrate 10, the wavelength of the current flowing through the conductors 12-1 to 12-3 becomes shorter than the wavelength in air of the radio wave corresponding to that current in accordance with the relative dielectric constant of the substrate 10. The current is at a minimum at each node of the standing wave, and a relatively strong electric field is formed around the node. For convenience, the wavelength of the current flowing through the conductors 12-1 to 12-3 due to the radio wave received or to be radiated by the shelf antenna 1 will hereinafter be referred to as the design wavelength.

Figure 3:
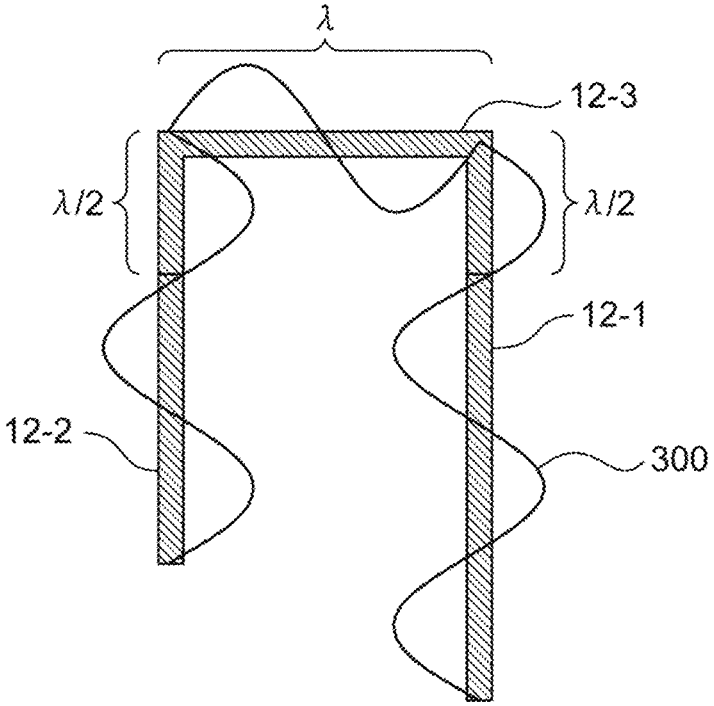
FIG. 3 is a schematic diagram illustrating the phase of current flowing through conductors.

FIG. 3 is a schematic diagram illustrating the phase of the current flowing through the conductors. In FIG. 3, a curve 300 describes the phase of the current having the design wavelength λ and flowing through each of the conductors 12-1 to 12-3 in terms of the distance from the conductor at every point along the curve 300. In the present embodiment, the length of the conductor 12-3, i.e., the electrical length, is equal to an integral multiple of the design wavelength λ (in FIG. 3, twice the design wavelength). Further, the end point of the conductor 12-1 and the end point of the conductor 12-2 that are connected to the conductor 12-3 are located at the same position when viewed across the longitudinal direction of the substrate 10. As a result, the phase of the current flowing through the conductor 12-1 and the phase of the current flowing through the conductor 12-2 are the same at every point taken along the longitudinal direction of the substrate 10.

The resonators 13-1 to 13-8 are each formed from a loop-shaped conductor whose longitudinal length is approximately equal to one half of the design wavelength and whose loop length is approximately equal to the design wavelength, and are disposed on the upper surface of the substrate 10. In other words, the conductors 12-1 to 12-3 and the resonators 13-1 to 13-8 are disposed in the same plane.

As described above, a relatively strong electric field is formed around the conductors 12-1 to 12-3 at every position on the conductors 12-1 to 12-3 located away from the open end 12*b* by an integral multiple of one half of the design wavelength. However, the phase of the current flowing through the microstrip line is reversed at every half wavelength of the design wavelength along the conductors 12-1 to 12-3. As a result, if two resonators are arranged, one spaced apart from the other by one half of the design wavelength, on the same side when viewed along the shorter direction (hereinafter referred to as the width direction) of the substrate 10, the current is 180 degrees out of phase between the two resonators, i.e., the direction of the current is opposite. As a result, the electric fields generated by the two resonators cancel each other. On the other hand, if two resonators are arranged, one spaced apart from the other by an integral multiple of the design wavelength, on the same side when viewed along the width direction, the currents flowing through the respective resonators are in phase, i.e., the direction of the current is the same. If the direction of the current is the same between the two resonators, the electric fields generated by the respective resonators reinforce each other.

In view of the above, the resonators 13-1 and 13-2 are disposed so that one end of each resonator is located within a range where it electromagnetically couples the conductor 12-1 at a position spaced away from the open end 12*b* by a distance approximately equal to an integral multiple of one half of the design wavelength λ along the conductors 12-1 to 12-3. Further, the two resonators 13-1 and 13-2 are spaced apart from each other along the conductor 12-1 by a distance approximately equal to the design wavelength λ. Likewise, the resonators 13-3 and 13-4 are disposed so that one end of each resonator is located within a range where it electromagnetically couples the conductor 12-2 at a position spaced away from the open end 12*b* by a distance approximately equal to an integral multiple of the design wavelength λ along the conductor 12-2. Further, the two resonators 13-3 and 13-4 are spaced apart from each other along the conductor 12-2 by a distance approximately equal to the design wavelength λ. With this arrangement, each of the resonators 13-1 to 13-4 electromagnetically couples the microstrip line of the conductors 12-1 to 12-3 by the electric field formed near the node of the standing wave of the current flowing through the conductors 12-1 to 12-3 due to the radio wave having the design wavelength. As a result, a current proportional to the radio wave having the design wavelength is excited in each of the resonators 13-1 to 13-4, so that the radio wave can be radiated or received. Further, each of the resonators 13-1 to 13-4 is disposed with its longitudinal direction crossing at right angles with the conductors 12-1 and 12-2. As a result, the resonators 13-1 to 13-4 can each form an electric field spreading in a direction different than the direction of the electric field produced by the microstrip line.

Further, the resonators 13-1 to 13-4 are disposed between the conductors 12-1 and 12-2 in order to increase the strength and uniformity of the electric field formed near the surface of the shelf antenna 1. More specifically, when viewed along the width direction of the substrate 10, the positions of the resonators 13-1 and 13-2 relative to the conductor 12-1 are opposite to the positions of the resonators 13-3 and 13-4 relative to the conductor 12-2.

Furthermore, in the present embodiment, since the conductor 12-3 has a length equal to an integral multiple of the design wavelength, as described above, the phase of the current flowing through the conductor 12-1 and the phase of the current flowing through the conductor 12-2 are the same at every point taken along the longitudinal direction of the substrate 10. In view of this, the resonators 13-1 to 13-4 are arranged so that the resonators 13-1 and 13-2 are displaced from the resonators 13-3 and 13-4 by a distance approximately equal to one half of the design wavelength $\lambda$ along the conductor 12-1. More specifically, the resonators 13-1 and 13-2 that electromagnetically couple the conductor 12-1 and the resonators 13-3 and 13-4 that electromagnetically couple the conductor 12-2 are arranged in alternating fashion along the conductor 12-1 at intervals of approximately one half of the design wavelength $\lambda$. As a result, the distance between each resonator that electromagnetically couples the conductor 12-1 and each resonator that electromagnetically couples the conductor 12-2, measured along the conductors 12-1 to 12-3, is approximately equal to $(m+1/2)\lambda$ (where m is an integer not smaller than 1, and $\lambda$ is the design wavelength). With this arrangement, the currents flowing through the respective resonators 13-1 to 13-4 are in phase, and the electric fields formed by the currents flowing through the respective resonators 13-1 to 13-4 are in phase so that the electric fields can reinforce each other.

As described above, each of the resonators 13-1 to 13-4 is formed in the shape of a loop and has a longitudinal length approximately equal to one half of the design wavelength. Since the current flowing through each resonator due to the radio wave received or to be radiated by the shelf antenna 1 is an alternating current, phase reversals occur at every half wavelength of the alternating current; i.e., the direction of the current is reversed at every half wavelength. Therefore, in the case of a resonator formed in the shape of a loop and having a longitudinal length approximately equal to one half of the design wavelength, the direction of the current flowing in one longitudinal section of the resonator is the same as the direction of the current flowing through the other longitudinal section. As a result, the electric fields generated from the two longitudinal sections can reinforce each other.

On the other hand, the resonators 13-5 and 13-6 are arranged with their longitudinal direction substantially parallel to the longitudinal direction of the conductor 12-1, i.e., substantially perpendicular to the longitudinal direction of the resonators 13-1 and 13-2. Further, the resonators 13-5 and 13-6 are arranged so that the resonators are each located in close proximity to an antinode of the standing wave of the current flowing through the conductor 12-1, i.e., the portion where the magnetic field generated by the current flowing through the conductor 12-1 is at a maximum. Further, in the present embodiment, the resonators 13-5 and 13-6 are each disposed so that one end thereof is located in the vicinity of a node of the standing wave of the current flowing through the conductor 12-1, i.e., the portion in close proximity to which the resonator 13-1 or 13-2 respectively is disposed. However, the position of the resonator 13-5 along the conductor 12-1 is not limited to the illustrated example, but it can be adjusted within a range where the resonator 13-5 can electromagnetically couple the standing wave's antinode nearest to the resonator 13-1. Likewise, the position of the resonator 13-6 along the conductor 12-1 can be adjusted within a range where the resonator 13-6 can electromagnetically couple the standing wave's antinode nearest to the resonator 13-2.

Since the longitudinal length of each of the resonators 13-5 and 13-6 is approximately equal to one half of the design wavelength, and since the distance between a node of the standing wave and its neighboring antinode is one quarter of the design wavelength, the center portion of each of the resonators 13-5 and 13-6 is located near an antinode of the standing wave of the current flowing through the conductor 12-1. As a result, the resonators 13-5 and 13-6 electromagnetically couple the conductor 12-1 by the current flowing through the conductor 12-1 or the magnetic field generated by that current. If the distance from the resonators 13-5 and 13-6 to the conductor 12-1 is greater than the distance from the resonators 13-1 and 13-2 to the conductor 12-1, the resonators 13-5 and 13-6 can electromagnetically couple the conductor 12-1. This is because the resonators 13-5 and 13-6 are arranged substantially parallel to the conductor 12-1.

Further, the distance between the end point of the resonator 13-5 nearer to the feed point 12*a* and the end point of the resonator 13-6 nearer to the feed point 12*a* is chosen to be approximately equal to the design wavelength so that the currents flowing through the respective resonators 13-5 and 13-6 are in phase.

Likewise, the resonators 13-7 and 13-8 are arranged with their longitudinal direction substantially parallel to the longitudinal direction of the conductor 12-2, i.e., substantially perpendicular to the longitudinal direction of the resonators 13-3 and 13-4. Further, the resonators 13-7 and 13-8 are arranged so that the resonators are each located in close proximity to an antinode of the standing wave of the current flowing through the conductor 12-2, i.e., the portion where the magnetic field generated by the current flowing through the conductor 12-2 is at a maximum. Further, the resonators 13-7 and 13-8 are each disposed so that one end thereof is located in the vicinity of a node of the standing wave of the current flowing through the conductor 12-2, i.e., the portion in close proximity to which the resonator 13-3 or 13-4 respectively is disposed.

Further, it is preferable to dispose the resonator 13-7 at the position corresponding to the position of the resonator 13-5 when viewed along the direction parallel to the conductor 12-2 so that the current flowing through the resonator 13-7 and the current flowing through the resonator 13-5 are in phase with each other. Likewise, it is preferable to dispose the resonator 13-8 at the position corresponding to the position of the resonator 13-6 when viewed along the direction parallel to the conductor 12-2 so that the current flowing through the resonator 13-8 and the current flowing through the resonator 13-6 are in phase with each other.

When the resonators are arranged as described above, the resonators 13-1 to 13-4 generate electric fields substantially perpendicular to the longitudinal direction of the conductors 12-1 and 12-2. On the other hand, the resonators 13-5 to 13-8 generate electric fields substantially parallel to the longitudinal direction of the conductors 12-1 and 12-2. Further, the phase of the current at each node of the standing wave is displaced by $\pi/4$ with respect to the phase of the current at its neighboring antinode. As a result, the currents flowing through the respective resonators 13-5 to 13-8 are displaced in phase by $\pi/4$ with respect to the currents flowing through the respective resonators 13-1 to 13-4. Since the phases of the currents flowing through the respective resonators vary in synchronized fashion, the electric fields generated by the resonators 13-1 and 13-5 result in circular polarization. Likewise, the electric fields generated by the resonators 13-2 and 13-6, the electric fields generated by the resonators 13-3 and 13-7, and the electric fields generated by the resonators 13-4 and 13-8 also result in circular polarization. As a result, near the surface of the shelf antenna 1, the combination of the instantaneous electric field component strength in the direction parallel to the conductors 12-1 and 12-2 and the instantaneous electric field component strength in the direction perpendicular to that direction also varies as the phases of the currents flowing through the respective resonators vary. Consequently, the instantaneous direction of the electric field also varies. As a result, the shelf antenna 1 can make the strength of the electric field uniform, regardless of the direction of the electric field.

Simulation results of the antenna characteristics of the shelf antenna 1 will be described below.

Figure 4:
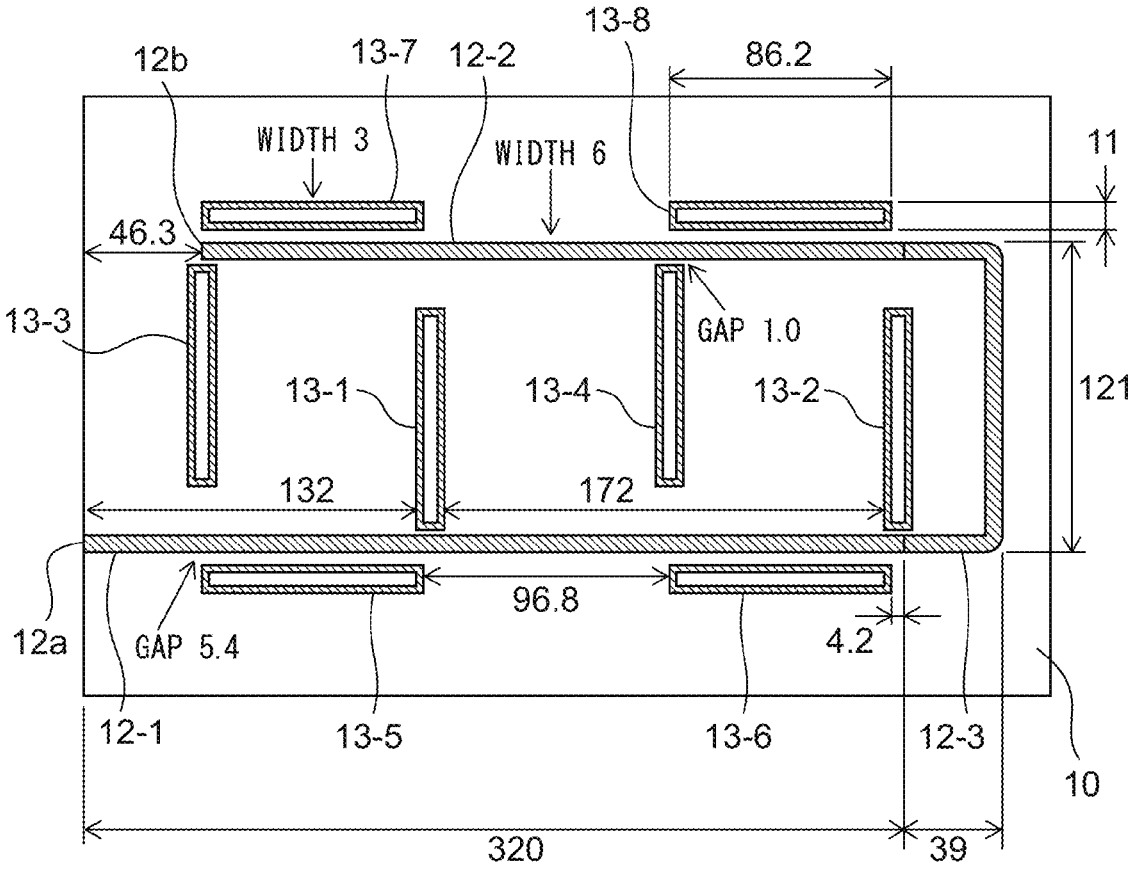
FIG. 4 is a plan view illustrating the dimensions of the various parts of the shelf antenna according to the first embodiment used in simulation.

FIG. 4 is a plan view illustrating the dimensions of the various parts of the shelf antenna 1 used in the simulation. In this simulation, the relative dielectric constant $\epsilon r$ of the dielectric forming the substrate 10 is assumed to be 4.0, and the dielectric loss tangent tan $\delta$ is assumed to be 0.01. It is also assumed that the ground electrode 11, the conductors 12-1 to 12-3, and the resonators 13-1 to 13-8 are each formed from copper (conductivity $\sigma=5.8\times10^7$ S/m). Further, the wavelength of the current flowing through the conductors 12-1 to 12-3 (corresponding to 920 MHz in frequency) is taken as the design wavelength $\lambda$. Further, in this simulation, the width direction and longitudinal direction of the substrate 10 are, for convenience, taken as the x direction and y direction, respectively. The direction normal to the surface of the substrate 10 is taken as the z direction.

In this simulation, the thickness of the substrate 10 is assumed to be 3 mm. As depicted in FIG. 4, the width of each of the conductors 12-1 to 12-3 is 6 mm. Further, the conductors 12-1 to 12-3 are 320 mm and 273.7 mm, respectively, in length as measured along the longitudinal direction of the substrate 10, and the distance from the edge of the substrate 10 coinciding with the feed point 12*a* of the conductor 12-2 to the open end 12*b* of the conductor 12-2 is 46.3 mm. The overall length of the conductor 12-3 is 199 mm. The spacing between the conductors 12-1 and 12-2, i.e., the length of the conductor 12-3 measured along the width direction of the substrate 10, is 121 mm.

On the other hand, the width of the conductor forming each of the resonators 13-1 to 13-8 is 3 mm, and the spacing between the two longitudinal conductor sections of each resonator is 5 mm. Further, the longitudinal length of each resonator is 86.2 mm (the longitudinal length of the spacing inside the loop is 79.2 mm). The distance from the feed point 12*a* to the resonator 13-1 is 132 mm. The spacing between the resonators 13-1 and 13-2 and the spacing between the resonators 13-3 and 13-4 are each 172 mm. The spacing between the resonators 13-1 and 13-3, the spacing between the resonators 13-3 and 13-2, and the spacing between the resonators 13-2 and 13-4 are each 80.5 mm.

The spacing along the longitudinal direction of the substrate 10 between one end of each of the resonators 13-5 to 13-8 and the center of one of the resonators 13-1 to 13-4 that is closest to the one end is 4.2 mm. For example, the spacing along the longitudinal direction of the substrate 10 between the one end of the resonator 13-5 that is nearer to the resonator 13-1 and the center of the resonator 13-1 is 4.2 mm. The spacing between the resonators 13-5 and 13-6 and the spacing between the resonators 13-7 and 13-8 are each 96.8 mm.

Figure 5:
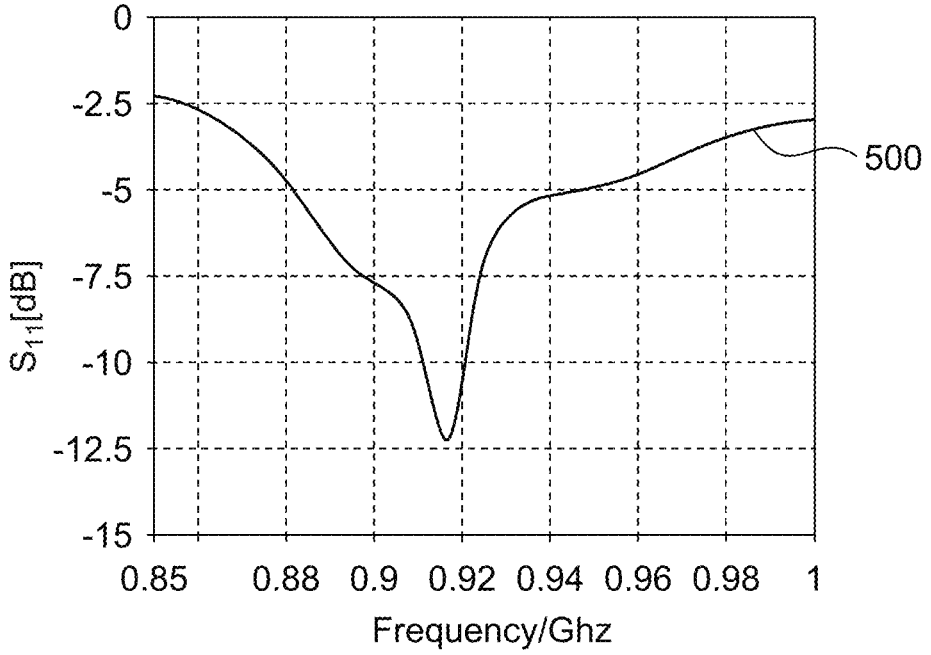
FIG. 5 is a diagram depicting a simulation result of the frequency characteristic of an S-parameter of the shelf antenna according to the first embodiment.

FIG. 5 is a diagram depicting the simulation result of the frequency characteristic of an S-parameter of the shelf antenna 1. In FIG. 5, the abscissa represents the frequency [GHz] and the ordinate represents the S11 parameter value [dB]. Graph 500 depicts the frequency characteristic of the S11 parameter of the shelf antenna 1 obtained by electromagnetic field simulation using a finite integration technique. As depicted by the graph 500, it can be seen that the S11 parameter of the shelf antenna 1 stays below −10 dB, a criterion for good antenna characteristic, in the vicinity of 920 MHz within the 900 MHz band used in the RFID system.

Figure 6:
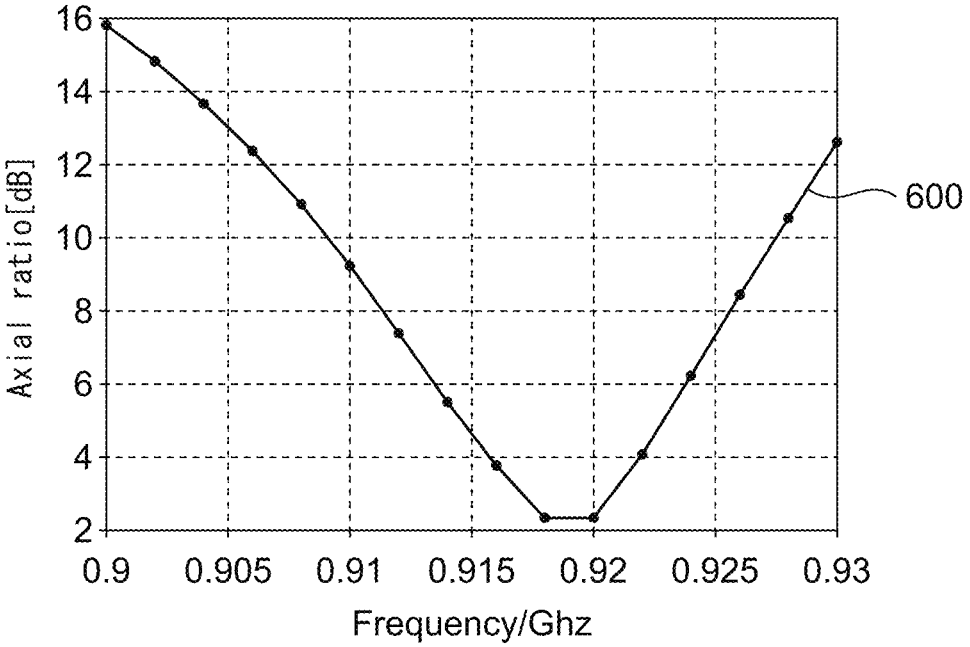
FIG. 6 is a diagram depicting a simulation result of the axial ratio of an electric field formed by the shelf antenna according to the first embodiment.

FIG. 6 is a diagram depicting the simulation result of the axial ratio of the electric field formed by the shelf antenna 1. In FIG. 6, the abscissa represents the frequency [GHz] and the ordinate represents the axial ratio [dB]. Graph 600 depicts the frequency characteristic of the axial ratio of the shelf antenna 1 obtained by electromagnetic field simulation using a finite integration technique. As depicted by the graph 600, the axial ratio of the shelf antenna 1 stays below 2 dB in the vicinity of 920 MHz, which indicates that the electric field formed by the shelf antenna 1 produces a very well circularly polarized pattern.

Figure 7A:
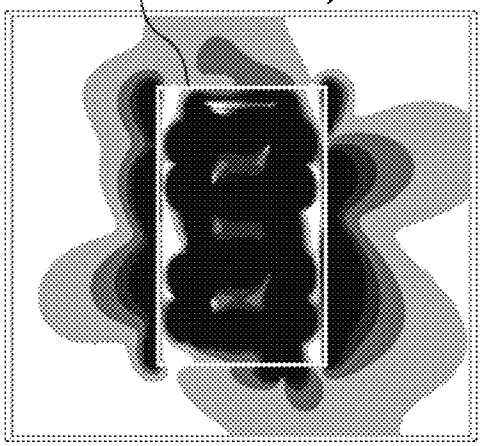
FIG. 7A is a diagram depicting a simulation result of the intensity distribution of a direction component of the electric field in an x-y plane elevated 2 mm above the surface of a substrate along the z axis.
Figure 7B:
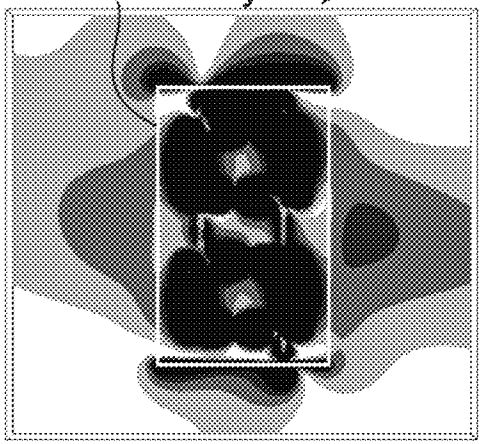
FIG. 7B is a diagram depicting a simulation result of the intensity distribution of a direction component of the electric field in the x-y plane elevated 2 mm above the surface of the substrate along the z axis.
Figure 7C:
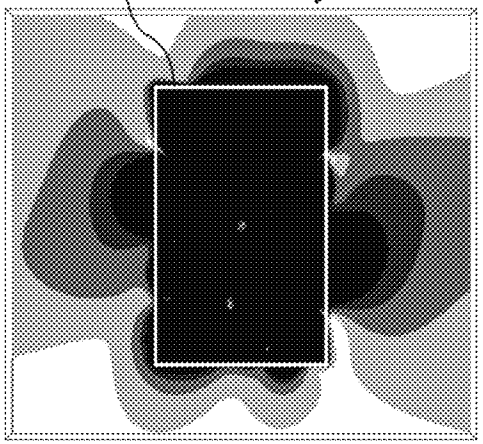
FIG. 7C is a diagram depicting a simulation result of the intensity distribution of a direction component of the electric field in the x-y plane elevated 2 mm above the surface of the substrate along the z axis.
Figure 7D:
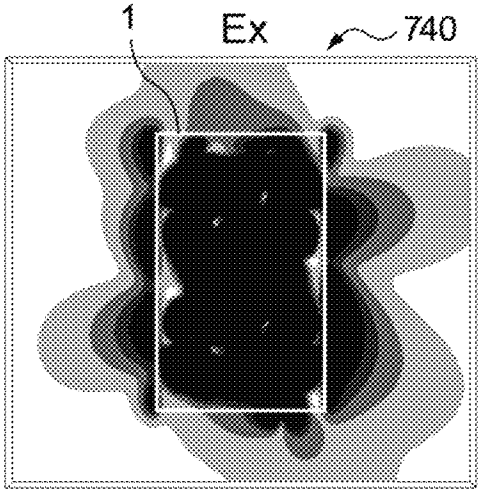
FIG. 7D is a diagram depicting a simulation result of the intensity distribution of a direction component of the electric field in the x-y plane elevated 7 mm above the surface of the substrate along the z axis.
Figure 7E:
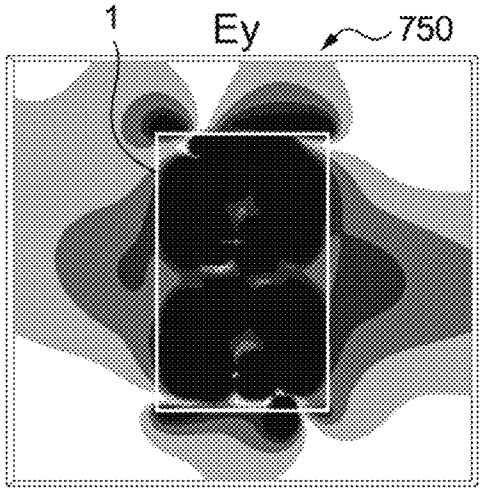
FIG. 7E is a diagram depicting a simulation result of the intensity distribution of a direction component of the electric field in the x-y plane elevated 7 mm above the surface of the substrate along the z axis.
Figure 7F:
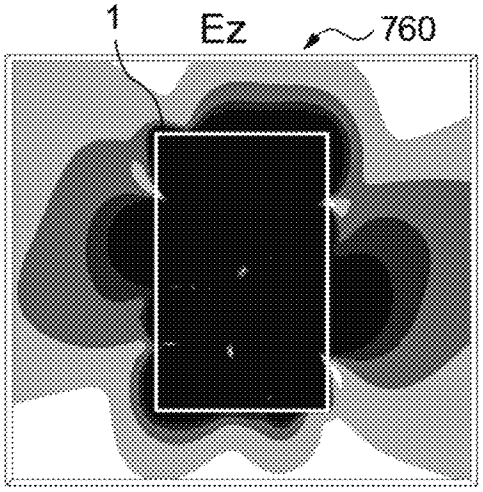
FIG. 7F is a diagram depicting a simulation result of the intensity distribution of a direction component of the electric field in the x-y plane elevated 7 mm above the surface of the substrate along the z axis.

FIGS. 7A to 7C each depict the intensity distribution of each direction component of the electric field in a plane parallel to the upper surface of the substrate 10, i.e., in the x-y plane, elevated 2 mm above the surface of the substrate 10 along the z axis. Similarly, FIGS. 7D to 7F each depict the intensity distribution of each direction component of the electric field in the x-y plane elevated 7 mm above the surface of the substrate 10 along the z axis. It is assumed that the frequency of the radio wave is 920 MHz. The distribution 710 depicted in FIG. 7A and the distribution 740 depicted in FIG. 7D each represent the distribution of the x direction component of the electric field. The distribution 720 depicted in FIG. 7B and the distribution 750 depicted in FIG. 7E each represent the distribution of the y direction component of the electric field. The distribution 740 depicted in FIG. 7C and the distribution 760 depicted in FIG. 7F each represent the distribution of the z direction component of the electric field. In the distributions 710 to 760, darker areas indicate areas of stronger electric fields. As can be seen from the distributions 710 to 760, each of the x, y, and z direction components of the electric field spreads uniformly near the surface of the shelf antenna 1.

Figure 8A:
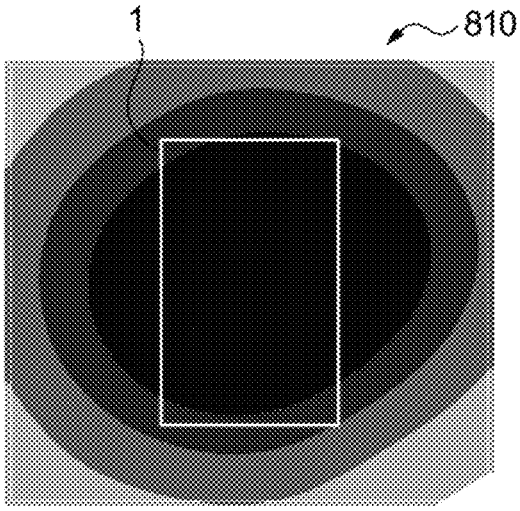
FIG. 8A is a diagram depicting a simulation result of the intensity distribution of a direction component of the electric field in the x-y plane elevated 30 mm above the surface of the substrate along the z axis.
Figure 8B:
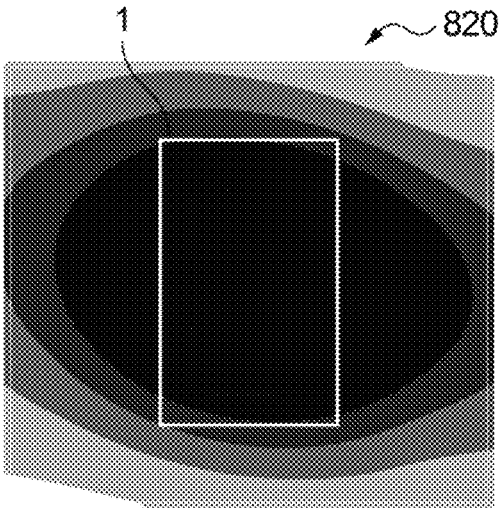
FIG. 8B is a diagram depicting a simulation result of the intensity distribution of a direction component of the electric field in the x-y plane elevated 30 mm above the surface of the substrate along the z axis.
Figure 8C:
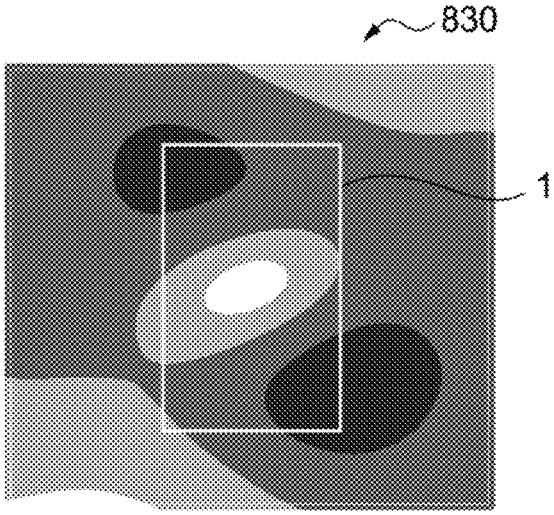
FIG. 8C is a diagram depicting a simulation result of the intensity distribution of a direction component of the electric field in the x-y plane elevated 30 mm above the surface of the substrate along the z axis.

FIGS. 8A to 8C each depict the intensity distribution of each direction component of the electric field in the x-y plane elevated 30 mm above the surface of the substrate 10 along the z axis. It is assumed that the frequency of the radio wave is 920 MHz. The distribution 810 depicted in FIG. 8A represents the distribution of the x direction component of the electric field. The distribution 820 depicted in FIG. 8B represents the distribution of the y direction component of the electric field. The distribution 830 depicted in FIG. 8C represents the distribution of the z direction component of the electric field. In the distributions 810 to 830, darker areas indicate areas of stronger electric fields. At the position 30 mm above the upper surface of the substrate 10, the z direction component of the electric field is weaker, but compared with the position 7 mm above the upper surface of the substrate 10, it can be seen that the x and y direction components spread more uniformly while maintaining sufficient intensity.

Figure 9A:
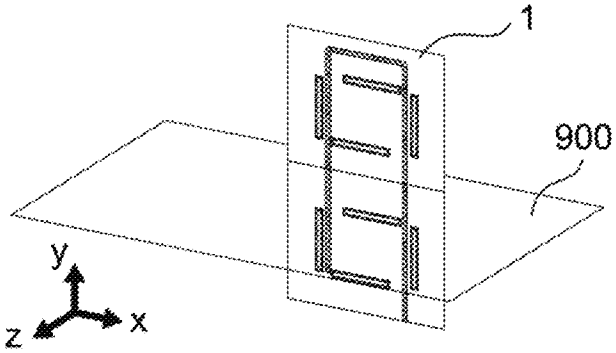
FIG. 9A is a diagram depicting an x-z plane defined to examine the intensity distribution of the electric field.
Figure 9B:
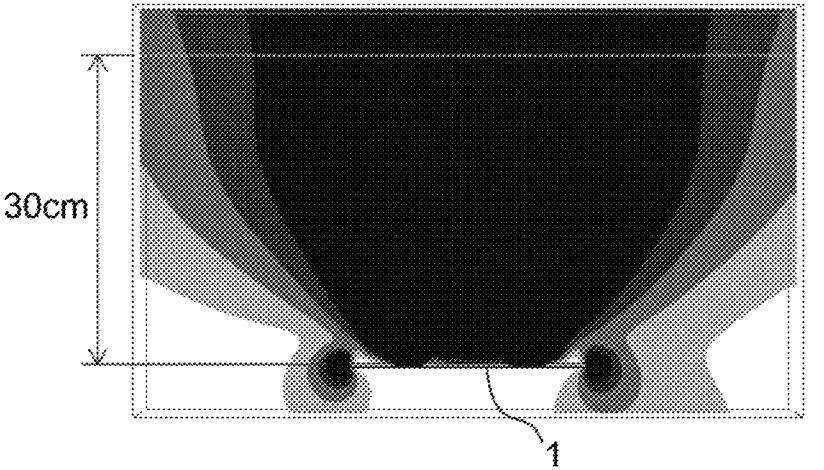
FIG. 9B is a diagram depicting a simulation result of the intensity distribution of a direction component of the electric field in the x-z plane.
Figure 9C:
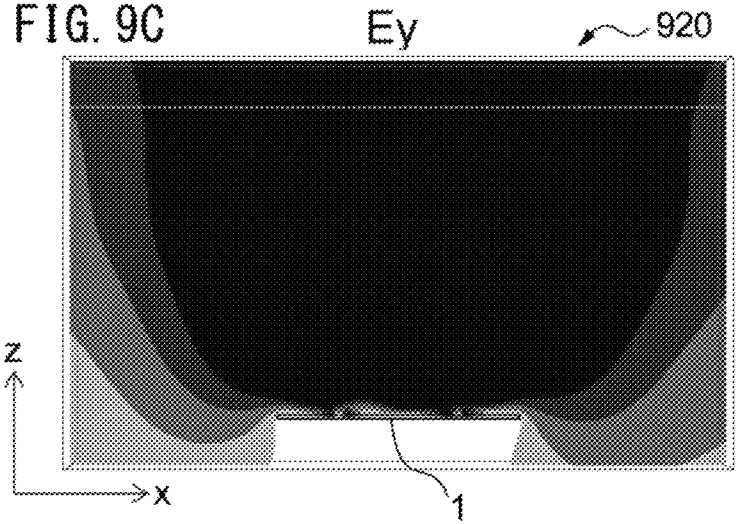
FIG. 9C is a diagram depicting a simulation result of the intensity distribution of a direction component of the electric field in the x-z plane.
Figure 9D:
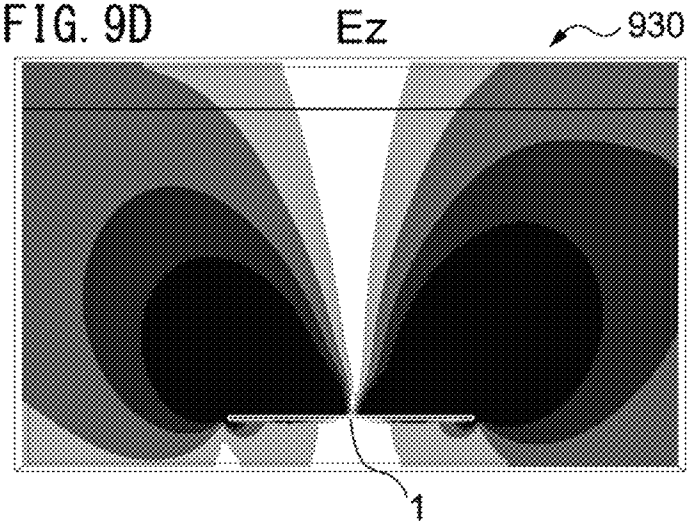
FIG. 9D is a diagram depicting a simulation result of the intensity distribution of a direction component of the electric field in the x-z plane.

FIG. 9A depicts an x-z plane 900 defined to examine the intensity distribution of the electric field. The x-z plane 900 is defined in the longitudinal center of the shelf antenna 1. FIGS. 9B to 9D each depict the intensity distribution of each direction component of the electric field in the x-z plane 900. It is assumed that the frequency of the radio wave is 920 MHz. The distribution 910 depicted in FIG. 9B represents the distribution of the x direction component of the electric field. The distribution 920 depicted in FIG. 9C represents the distribution of the y direction component of the electric field. The distribution 930 depicted in FIG. 9D represents the distribution of the z direction component of the electric field. In the distributions 910 to 930, darker areas indicate areas of stronger electric fields. As can be seen from the distributions 910 and 920, both the x and y direction components of the electric field spread uniformly in the x-z plane 900. Further, as indicated by the distribution 930, the z direction component of the electric field also spreads uniformly as a whole, though it is slightly weaker in the widthwise center of the substrate 10.

Figure 10A:
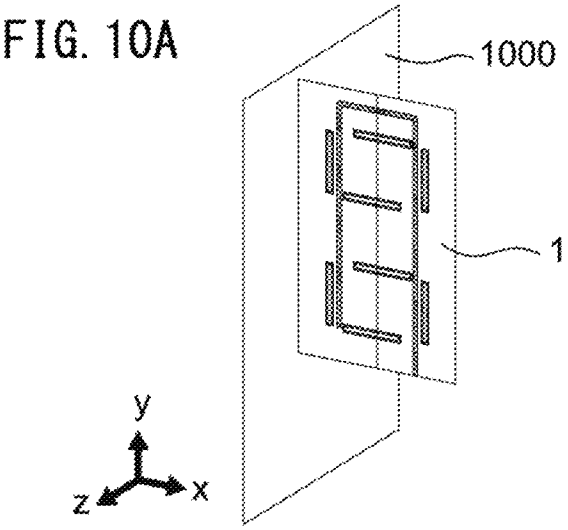
FIG. 10A is a diagram depicting a y-z plane defined to examine the intensity distribution of the electric field.
Figure 10B:
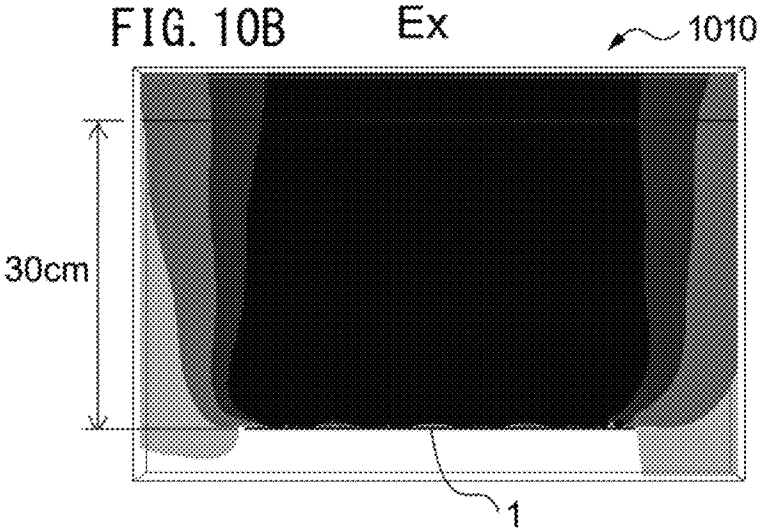
FIG. 10B is a diagram depicting a simulation result of the intensity distribution of a direction component of the electric field in the y-z plane.
Figure 10C:
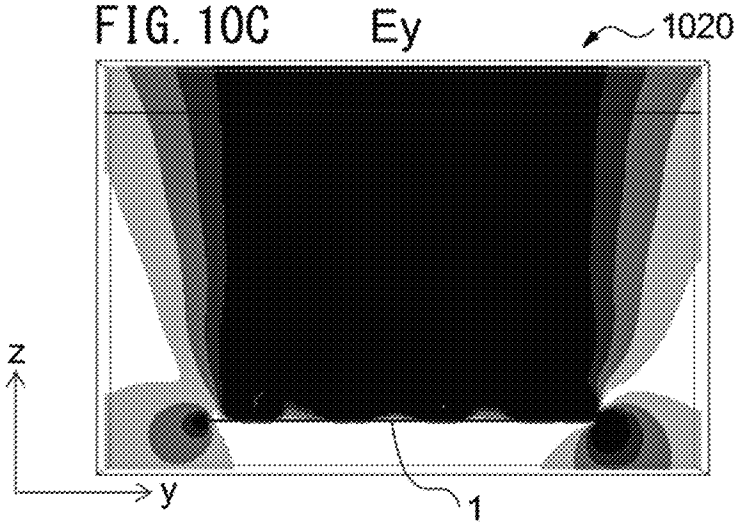
FIG. 10C is a diagram depicting a simulation result of the intensity distribution of a direction component of the electric field in the y-z plane.
Figure 10D:
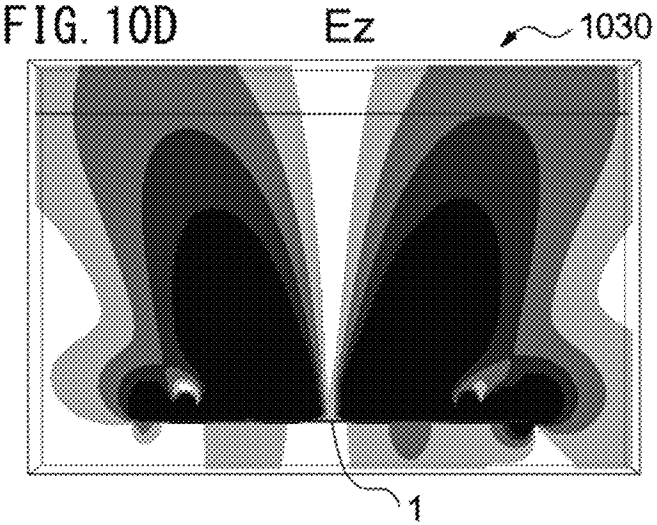
FIG. 10D is a diagram depicting a simulation result of the intensity distribution of a direction component of the electric field in the y-z plane.

FIG. 10A depicts a y-z plane 1000 defined to examine the intensity distribution of the electric field. The y-z plane 1000 is defined in the widthwise center of the shelf antenna 1. FIGS. 10B to 10D each depict the intensity distribution of each direction component of the electric field in the y-z plane 1000. It is assumed that the frequency of the radio wave is 920 MHz. The distribution 1010 depicted in FIG. 10B represents the distribution of the x direction component of the electric field. The distribution 1020 depicted in FIG. 10C represents the distribution of the y direction component of the electric field. The distribution 1030 depicted in FIG. 10D represents the distribution of the z direction component of the electric field. In the distributions 1010 to 1030, darker areas indicate areas of stronger electric fields. As can be seen from the distributions 1010 and 1020, both the x and y direction components of the electric field spread uniformly in the y-z plane 1000. Further, as indicated by the distribution 1030, the z direction component of the electric field also spreads uniformly as a whole, though it is slightly weaker in the widthwise center of the substrate 10.

As has been described above, the shelf antenna includes two parallelly arranged conductors each forming a microstrip line. The antenna is fed at one end of one of the two conductors, and the other end at which it is not fed is connected to one end of the other conductor by a conductor having a length equal to an integral multiple of the design wavelength. Then, there are disposed between the two parallelly arranged conductors a plurality of resonators along the respective conductors. More specifically, the resonators that resonate with one conductor and the resonators that resonate with the other conductor are arranged in alternating fashion with one spaced apart from another by a distance approximately equal to one half of the design wavelength so that the currents flowing through the respective resonators are in phase and, therefore, the electric fields generated by the respective resonators are also in phase and reinforce each other. With this arrangement, not only can the uniformity of the electric field formed near the surface of the shelf antenna be enhanced, but the strength of the electric field can also be increased. Furthermore, in this shelf antenna, since the resonators and the conductors forming the microstrip lines are formed in the same plane, there is no need to form the substrate in a multilayered structure. This serves to reduce the manufacturing cost of the shelf antenna.

Next, a shelf antenna according to a second embodiment will be described. The shelf antenna according to the second embodiment differs from the shelf antenna according to the first embodiment in that the two conductors arranged in parallel along the longitudinal direction of the substrate 10 are separately fed and in that the conductor connecting between the two conductors is omitted. Therefore, the conductors and their related parts will be described below. For the other component elements of the shelf antenna of the second embodiment, refer to the description earlier given of the corresponding component elements of the shelf antenna of the first embodiment.

Figure 11:
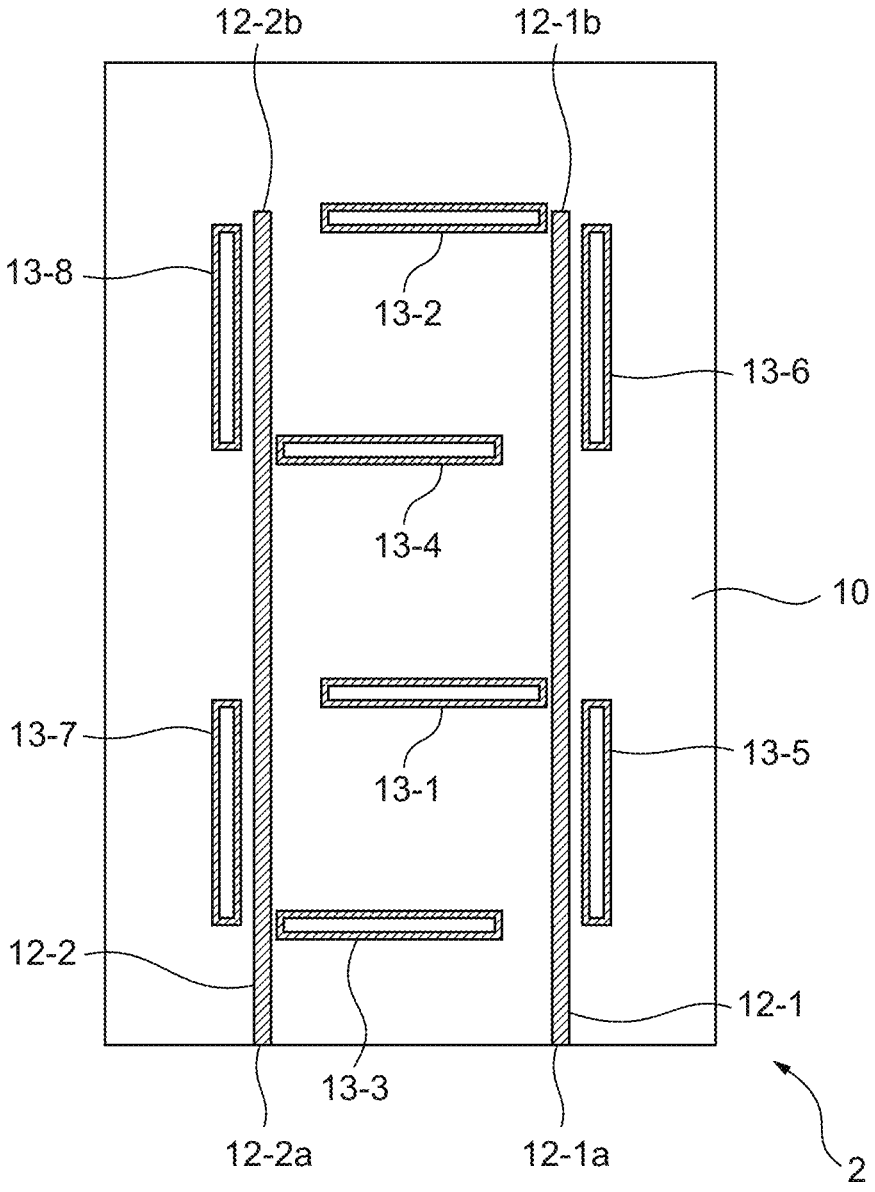
FIG. 11 is a plan view of a shelf antenna according to a second embodiment.

FIG. 11 is a plan view of the shelf antenna according to the second embodiment. In the shelf antenna 2 according to the second embodiment also, each of the two line conductors 12-1 and 12-2 arranged in parallel along the longitudinal direction of the substrate 10 forms a microstrip line in combination with the ground electrode (not depicted) formed on the lower surface of the substrate 10. The conductors 12-1 and 12-2 have the same length, and are separately fed at their feed points 12-1*a* and 12-2*a*, respectively, that are located at the same side edge of the substrate 10. In other words, the feed points 12-1*a* and 12-2*a* of the respective conductors 12-1 and 12-2 are connected via a power distributor (not depicted) to a communication circuit (not depicted) which processes radio frequency signals received or to be radiated by the shelf antenna 1. Then, the signals are fed from the communication circuit to the respective conductors 12-1 and 12-2 so that the signal fed to the conductor 12-1 is in phase with the signal fed to the conductor 12-2. The other ends of the respective conductors 12-1 and 12-2 are open ends 12-1*b* and 12-2*b*, respectively. Accordingly, the current flowing through the conductor 12-1 and the current flowing through the conductor 12-2 each result in the production of a standing wave, and the phase of the current flowing through the conductor 12-1 and the phase of the current flowing through the conductor 12-2 are the same at every point taken along the longitudinal direction of the substrate 10.

In this embodiment also, a relatively strong electric field is formed around the conductor 12-1 at every position on the conductor 12-1 located away from the open end 12-1*b* by an integral multiple of one half of the design wavelength. Likewise, a relatively strong electric field is formed around the conductor 12-2 at every position on the conductor 12-2 located away from the open end 12-2*b* by an integral multiple of one half of the design wavelength.

In view of the above, the two resonators 13-1 and 13-2, each of which resonate with the conductor 12-1 and is disposed with its longitudinal direction perpendicular to the conductor 12-1, are arranged so that one is located at a position spaced away from the open end 12-1*b* by a distance approximately equal to the design wavelength along the conductor 12-1 and the other at a position corresponding to the open end 12-1*b*. On the other hand, the two resonators 13-3 and 13-4, each of which resonate with the conductor 12-2 and is disposed with its longitudinally direction perpendicular to the conductor 12-2, are arranged so that one is located at a position spaced approximately one and a half of the design wavelength and the other at a position spaced approximately one half of the design wavelength from the open end 12-2*b* along the conductor 12-2. The resonators 13-1 to 13-4 are disposed between the conductors 12-1 and 12-2. Since the currents flowing through the respective resonators 13-1 to 13-4 arranged in alternating fashion as described above are in phase, the electric fields generated by the currents flowing through the respective resonators 13-1 to 13-4 are also in phase and can thus reinforce each other.

In this embodiment also, the resonators 13-5 and 13-6 are arranged with their longitudinal direction substantially parallel to the longitudinal direction of the conductor 12-1, i.e., substantially perpendicular to the longitudinal direction of the resonators 13-1 and 13-2. Further, the resonators 13-5 and 13-6 are arranged so that the resonators are each located in close proximity to an antinode of the standing wave of the current flowing through the conductor 12-1, i.e., the portion where the magnetic field generated by the current flowing through the conductor 12-1 is at a maximum. Further, the resonators 13-5 and 13-6 are each disposed so that one end thereof is located in the vicinity of a node of the standing wave of the current flowing through the conductor 12-1, i.e., the portion in close proximity to which the resonator 13-1 or 13-2 respectively is disposed.

Further, the distance between the end point of the resonator 13-5 nearer to the feed point 12-1*a* and the end point of the resonator 13-6 nearer to the feed point 12-1*a* is chosen to be approximately equal to the design wavelength so that the currents flowing through the respective resonators 13-5 and 13-6 are in phase.

Likewise, the resonators 13-7 and 13-8 are arranged with their longitudinal direction substantially parallel to the longitudinal direction of the conductor 12-2, i.e., substantially perpendicular to the longitudinal direction of the resonators 13-3 and 13-4. Further, the resonators 13-7 and 13-8 are arranged so that the resonators are each located in close proximity to an antinode of the standing wave of the current flowing through the conductor 12-2, i.e., the portion where the magnetic field generated by the current flowing through the conductor 12-2 is at a maximum. Further, the resonators 13-7 and 13-8 are each disposed so that one end thereof is located in the vicinity of a node of the standing wave of the current flowing through the conductor 12-2, i.e., the portion in close proximity to which the resonator 13-3 or 13-4 respectively is disposed.

Further, it is preferable to dispose the resonator 13-7 at the position corresponding to the position of the resonator 13-5 when viewed along the longitudinal direction of the substrate 10 so that the current flowing through the resonator 13-7 and the current flowing through the resonator 13-5 are in phase with each other. Likewise, it is preferable to dispose the resonator 13-8 at the position corresponding to the position of the resonator 13-6 when viewed along the longitudinal direction of the substrate 10 so that the current flowing through the resonator 13-8 and the current flowing through the resonator 13-6 are in phase with each other.

When the resonators are arranged as described above, the electric fields generated from the respective resonators result in circular polarization, as in the shelf antenna 1 of the first embodiment. In this way, the shelf antenna 2 can make the strength of the electric field uniform, regardless of the direction of the electric field.

Figure 12A:
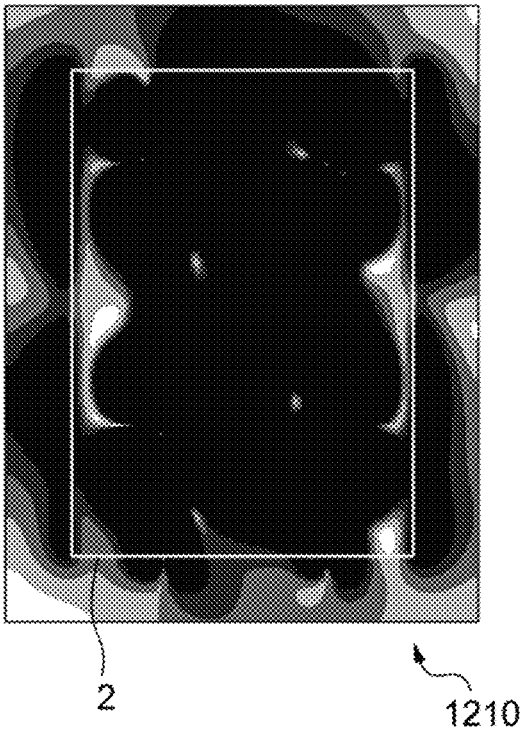
FIG. 12A is a diagram depicting a simulation result of the intensity distribution of a direction component of the electric field formed near the surface of the shelf antenna according to the second embodiment.
Figure 12B:
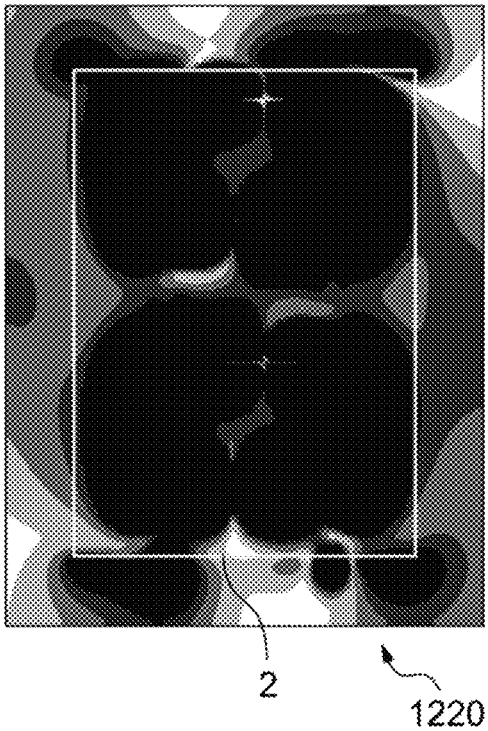
FIG. 12B is a diagram depicting a simulation result of the intensity distribution of a direction component of the electric field formed near the surface of the shelf antenna according to the second embodiment.

FIGS. 12A and 12B each depict the intensity distribution of a direction component of the electric field in the x-y plane elevated 7 mm above the surface of the substrate 10 along the z axis, which is obtained by electromagnetic field simulation. It is assumed that the physical properties of the various parts of the shelf antenna 2 used in this electromagnetic field simulation are the same as those of the corresponding parts of the shelf antenna 1. It is also assumed that the dimensions of the various parts of the shelf antenna 2 used in this electromagnetic field simulation are the same as those of the corresponding parts of the shelf antenna 1 depicted in FIG. 4, except for the length of the conductor 12-2. The length of the conductor 12-2 is the same as that of the conductor 12-1 (320 mm). It is also assumed that the frequency of the radio wave having the design wavelength is 920 MHz. The distribution 1210 depicted in FIG. 12A represents the distribution of the x direction component of the electric field. The distribution 1220 depicted in FIG. 12B represents the distribution of the y direction component of the electric field. In the distributions 1210 and 1220, darker areas indicate areas of stronger electric fields. As can be seen from the distributions 1210 and 1220, both the x and y direction components of the electric field spread uniformly.

Figure 13A:
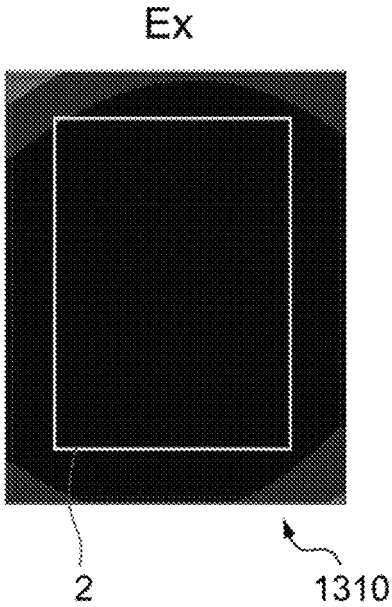
FIG. 13A is a diagram depicting a simulation result of the intensity distribution of a direction component of the electric field formed in a plane elevated 30 mm above the surface of the substrate according to the second embodiment.
Figure 13B:
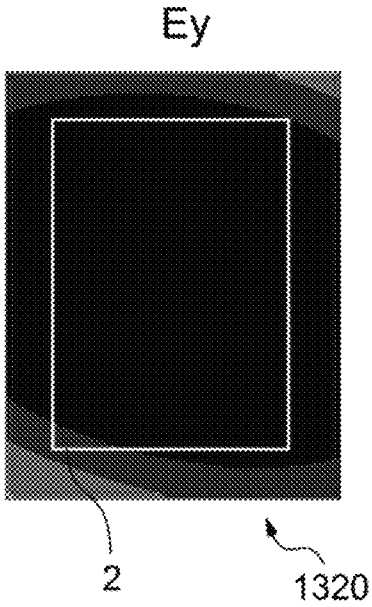
FIG. 13B is a diagram depicting a simulation result of the intensity distribution of a direction component of the electric field formed in the plane elevated 30 mm above the surface of the substrate according to the second embodiment.

FIGS. 13A and 13B each depict the intensity distribution of a direction component of the electric field in the x-y plane elevated 30 mm above the surface of the substrate 10 along the z axis. It is also assumed that the frequency of the radio wave having the design wavelength is 920 MHz. The distribution 1310 depicted in FIG. 13A represents the distribution of the x direction component of the electric field. The distribution 1320 depicted in FIG. 13B represents the distribution of the y direction component of the electric field. In the distributions 1310 and 1320, darker areas indicate areas of stronger electric fields. In the shelf antenna 2 also, it can be seen that at the position 30 mm above the upper surface of the substrate 10, compared with the position 7 mm above the upper surface of the substrate 10, the x and y direction components spread more uniformly while maintaining sufficient intensity.

In this way, the shelf antenna 2 according to the second embodiment achieves the same effect as that achieved by the shelf antenna 1 of the first embodiment.

According to a modified example, one of the conductors 12-1 and 12-2 may be extended toward the feed point by one half of the design wavelength, and at the same time, the phases of the currents fed to the respective conductors 12-1 and 12-2 may be reversed with respect to each other. In this case also, the phase of the current flowing through the conductor 12-1 and the phase of the current flowing through the conductor 12-2 are the same at every point taken along the longitudinal direction of the substrate 10. Therefore, by arranging the resonators in the same manner as the resonators in the shelf antenna 2 of FIG. 11, the strength of the electric field can be made uniform, as in the case of the shelf antenna 2, regardless of the direction of the electric field.

According to another modified example, the feed points of the conductors 12-1 and 12-2 and the end points 12-1*b* and 12-2*b* at the other ends thereof may be short-circuited to the ground electrode 11, for example, through vias formed in the substrate 10. In this case, the end points 12-1*b* and 12-2*b* are fixed ends for the currents flowing through the respective microstrip lines. In this case, nodes are formed at every position spaced $(1/4+n/2)\lambda$ (n is an integer not smaller than 0, and $\lambda$ is the design wavelength) away from the end point 12-1*b* along the conductor 12-1. Likewise, nodes are formed at every position spaced $(1/4+n/2)\lambda$ away from the end point 12-2*b* along the conductor 12-2. Accordingly, in this case, compared with the second embodiment, each resonator need only be shifted in position toward the feed point along the conductor 12-1 or 12-2 in such a manner that the distance from the end point 12-1*b* or 12-2*b* increases by $(1/4)\lambda$.

According to still another modified example, the feed point of one of the two parallelly arranged conductors and the end point at the other end thereof may be short-circuited to the ground electrode, for example, through vias formed in the substrate, and the end point of the other conductor, i.e., the end opposite to the feed point thereof, may be formed as an open end.

Figure 14:
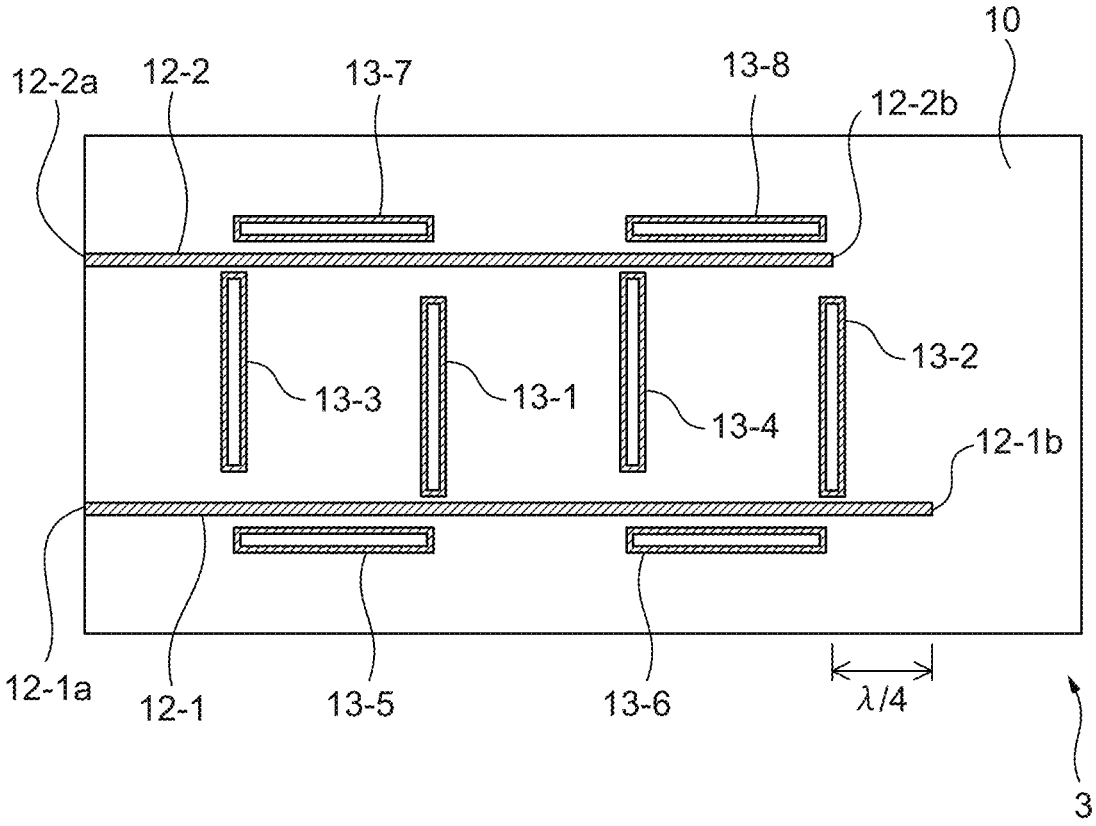
FIG. 14 is a plan view of a shelf antenna according to a modified example.

FIG. 14 is a plan view of a shelf antenna according to this modified example. In the shelf antenna 3 according to this modified example, of the two line conductors 12-1 and 12-2 arranged parallel to each other on the surface of the substrate 10, the end point 12-1*b* of the conductor 12-1 is short-circuited through a via to the ground electrode (not depicted) formed on the lower surface of the substrate 10. The conductor 12-1 is longer than the conductor 12-2 by one quarter of the design wavelength λ. As a result, compared with the end point 12-2*b* located on the side opposite to the feed point 12-2*a* of the conductor 12-2, the end point 12-1*b* of the conductor 12-1 is located one quarter of the design wavelength λ farther away from the edge of the substrate 10 at which the respective feed points are located. Further, compared with the shelf antenna 2, the resonators 13-1 and 13-2 which resonate with the conductor 12-1 are each shifted one quarter of the design wavelength λ farther away from the end point 12-1*b* toward the feed point 12-1*a*. When viewed from the feed point 12-1*a*, the resonators 13-1 and 13-2 in the shelf antenna 3 are located at the same positions as the corresponding resonators in the shelf antenna 2. Accordingly, the currents flowing through the respective resonators 13-1 to 13-4 are in phase. As a result, the electric fields generated from the respective resonators 13-1 to 13-4 are also in phase and can thus reinforce each other.

In this modified example also, the resonators 13-5 to 13-8 are arranged in the same manner as the resonators 13-5 to 13-8 in the second embodiment. In other words, the resonators 13-5 to 13-8 are arranged with their longitudinal direction substantially parallel to the longitudinal direction of the conductor 12-1 or 12-2. Further, it is preferable to dispose the resonators 13-5 and 13-7 at positions corresponding to each other when viewed along the longitudinal direction of the substrate 10 so that the current flowing through the resonator 13-7 and the current flowing through the resonator 13-5 are in phase with each other. Likewise, it is preferable to dispose the resonators 13-6 and 13-8 at positions corresponding to each other when viewed along the longitudinal direction of the substrate 10 so that the current flowing through the resonator 13-8 and the current flowing through the resonator 13-6 are in phase with each other. With this arrangement, the phase of the circular polarization produced by the resonators 13-1, 13-2, 13-5, and 13-6 becomes the same as that of the circular polarization produced by the resonators 13-3, 13-4, 13-7, and 13-8.

In the above embodiments and their modified examples, the shape of each resonator is not limited to a loop shape, but a dipole antenna having a length equal to one half of the design wavelength, for example, may be employed as the resonator.

Further, in the above embodiments and their modified examples, the resonators (for example, the resonators 13-5 to 13-8 in FIG. 1) disposed with their longitudinal direction parallel to the two parallelly arranged conductors may be omitted. In that case, the electric field radiated from the shelf antenna is not circular polarization, but the uniformity of the electric field and the enhancement of the field strength can be achieved by the resonators that are arranged with their longitudinal direction perpendicular to the respective conductors.

Furthermore, in this case, each resonator disposed between the two parallelly arranged conductors may be arranged so as to make an angle other than 90° with respect to the conductor to which it electromagnetically couples. However, it is preferable to arrange the resonators in parallel to each other so that the electric fields generated by the respective resonators are in phase and can reinforce each other.

According to a further modified example, the number of conductors forming the microstrip line is not limited to two, but may be three or more.

Figure 15:
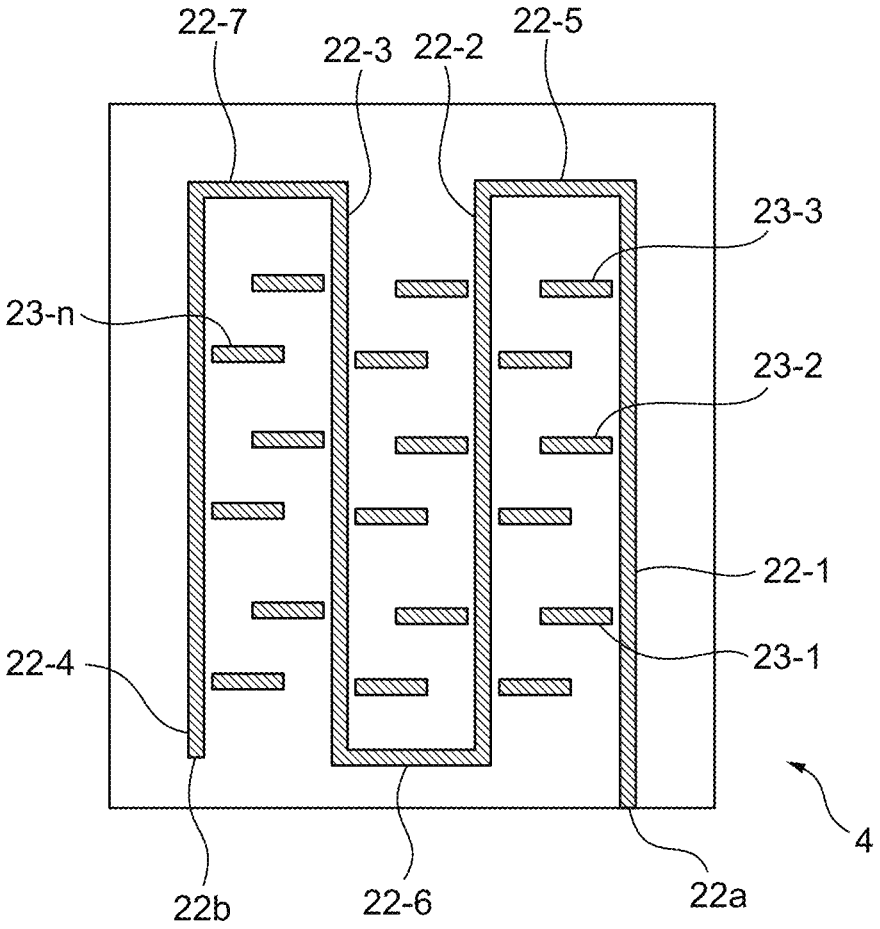
FIG. 15 is a plan view of a shelf antenna according to a further modified example.

FIG. 15 is a plan view of a shelf antenna according to this modified example. In the shelf antenna 4 according to this modified example, four line conductors 22-1 to 22-4 are arranged in parallel to each other on the substrate 10. Of these conductors, one end of the conductor 22-1 is a feed point 22*a*. The other end of the conductor 22-1 and the end of the conductor 22-2 farther from the edge of the substrate 10 at which the feed point 22*a* is located are connected by a line conductor 22-5 having a length equal to an integral multiple of the design wavelength. Likewise, the other end of the conductor 22-2 and the end of the conductor 22-3 nearer to the edge of the substrate 10 at which the feed point 22*a* is located are connected by a line conductor 22-6 having a length equal to an integral multiple of the design wavelength. Further, the other end of the conductor 22-3 and the end of the conductor 22-4 farther from the edge of the substrate 10 at which the feed point 22*a* is located are connected by a line conductor 22-7 having a length equal to an integral multiple of the design wavelength. The other end of the conductor 22-4 is an open end 22*b*.

There are arranged between two adjacent ones of the conductors from 22-1 to 22-4 a plurality of resonators 23-1 to 23-*n* each of which resonates with one of the two conductors. In FIG. 15, each resonator is indicated by a line, but each resonator may be formed from a loop-shaped conductor whose loop length is approximately equal to the design wavelength. Each resonator is disposed so that one end of the resonator electromagnetically couples one of the conductors at a position whose distance from the open end 22*b*, measured along the conductors 22-1 to 22-4, is approximately equal to an integral multiple of one half of the design wavelength. In the plurality of resonators that electromagnetically couple the same conductor and that are arranged on the same side of that conductor when viewed along the width direction of the substrate 10, the distance between any two adjacent resonators, measured along the longitudinal direction of the conductor, is approximately equal to the design wavelength. On the other hand, the resonators that electromagnetically couple respectively different conductors are arranged in alternating fashion so that each resonator that electromagnetically couples one conductor is spaced apart from its adjacent resonator that electromagnetically couples the other conductor by a distance approximately equal to one half of the design wavelength. As a result, the currents flowing through the respective resonators and having the design wavelength are in phase, and the electric fields generated from the respective resonators are also in phase and can thus reinforce each other, as in any of the above embodiments and their modified examples.

According to a still further modified example, the resonators may be arranged in a plane different from the plane in which the conductors forming the microstrip lines in combination with the ground electrode are arranged.

Figure 16A:
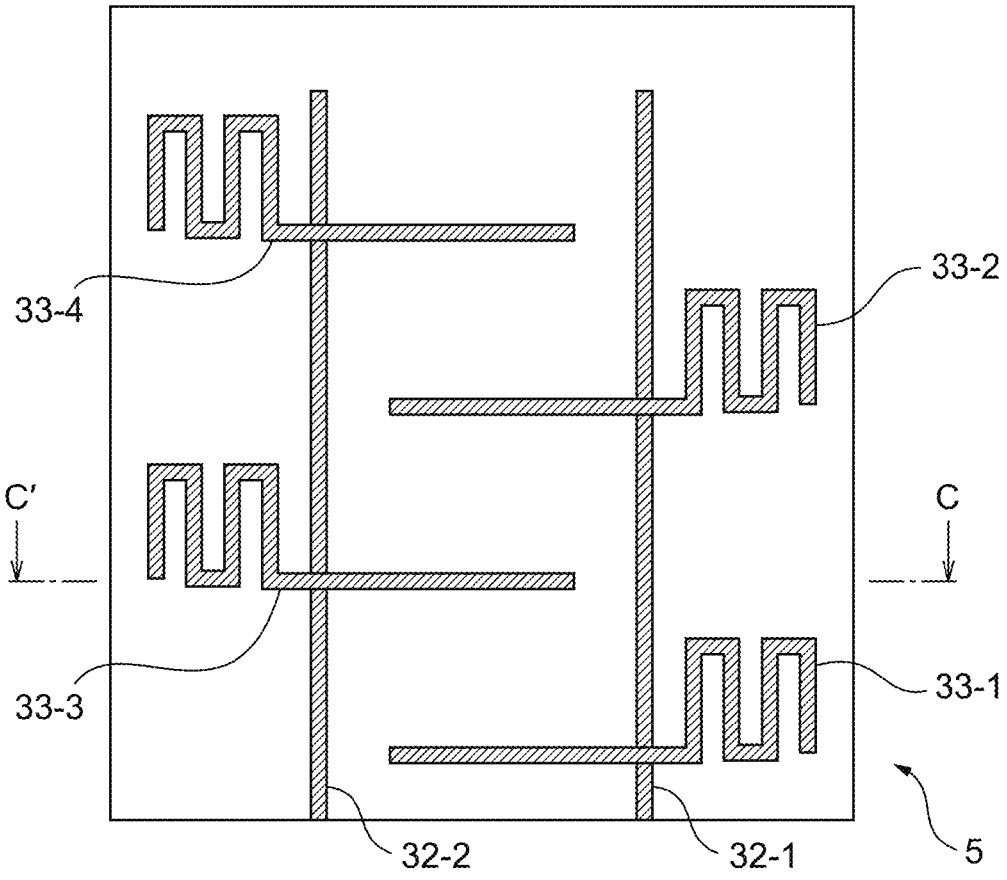
FIG. 16A is a plan view of a shelf antenna according to a still further modified example.
Figure 16B:
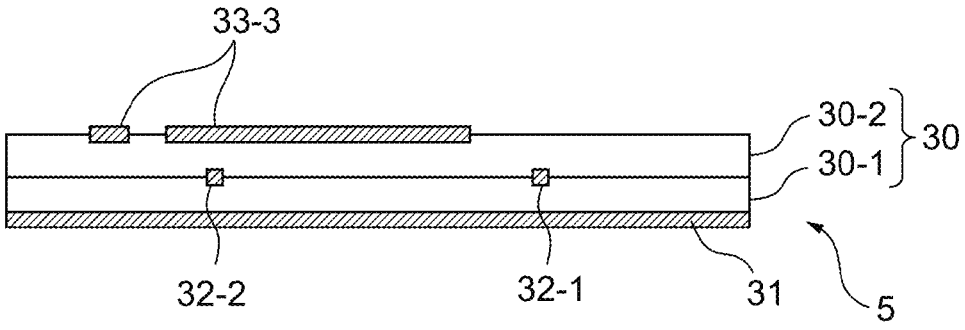
FIG. 16B is a cross-sectional side view taken along line CC' in FIG. 16A and viewed in the direction of arrow.

FIG. 16A is a plan view of a shelf antenna according to this modified example, and FIG. 16B is a cross-sectional side view taken along line CC' in FIG. 16A and viewed in the direction of the arrow. In the shelf antenna 5 according to this modified example, a substrate 30 formed from a dielectric material includes a first layer 30-1 and a second layer 30-2 in this order from the bottom. A ground electrode 31 is formed on the lower surface of the first layer 30-1. There are arranged between the first layer 30-1 and the second layer 30-2 two line conductors 32-1 and 32-2 extending in parallel to each other along the longitudinal direction of the substrate 30. A plurality of resonators 33-1 to 33-4 are arranged on the upper surface of the second layer 30-2.

The thickness of the first layer 30-1 and the thickness of the second layer 30-2 are chosen so that the characteristic impedance of the shelf antenna 5 becomes equal to a predetermined value. The thickness of the first layer 30-1 may be the same as, or different from, the thickness of the second layer 30-2. The relative dielectric constant of the first layer 30-1 may be the same as, or different from, the relative dielectric constant of the second layer 30-2.

The conductors 32-1 and 32-2 each form a microstrip line in combination with the ground electrode 31. As in the second embodiment, the conductors 32-1 and 32-2 have the same length, are fed from the same side, and have open ends at the other ends. The other ends of the conductors 32-1 and 32-2 may be formed as fixed ends by being short-circuited to the ground electrode 31.

The resonators 33-1 and 33-2 are each disposed at a position spaced, for example, an integral multiple of the design wavelength λ away from the open end of the conductor 32-1 along the longitudinal direction of the conductor 32-1 so as to resonate with the conductor 32-1. The spacing between the resonators 33-1 and 33-2 along the longitudinal direction of the conductor 32-1 is approximately equal to the design wavelength λ. On the other hand, the resonators 33-3 and 33-4 are each disposed at a position spaced, for example, a distance (integral multiple of λ+λ/2) away from the open end of the conductor 32-2 along the longitudinal direction of the conductor 32-2 so as to resonate with the conductor 32-2. The spacing between the resonators 33-3 and 33-4 along the longitudinal direction of the conductor 32-1 is approximately equal to the design wavelength λ.

Further, in this modified example, the resonators 33-1 to 33-4 are each formed as a dipole antenna having a length approximately equal to the design wavelength. Further, each of the resonators 33-1 to 33-4 is formed so that the portion thereof that is located between the conductors 32-1 and 32-2 extends in a direction perpendicular to the longitudinal direction of the conductor 32-1. On the other hand, the portion of each of the resonators 33-1 to 33-4 that is not located between the conductors 32-1 and 32-2 may be formed in a serpentine fashion as depicted in FIG. 16A or may be formed in the shape of a straight line or curved line.

In this modified example also, since the currents flowing through the respective resonators and having the design wavelength are in phase, the electric fields generated from the respective resonators are also in phase and can thus reinforce each other. As in the above embodiments and their modified example, since the resonators used in this shelf antenna can be arranged with closer spacing than would be the case if the resonators were arranged along a single microstrip line, the electric field can be made uniform.

In the above embodiments and their modified example, the plurality of parallelly arranged conductors may be arranged along a direction other than the longitudinal direction of the substrate. Further, the number of resonators need only be determined according to the size required of the antenna. For example, the number of resonators that electromagnetically couple each of the two parallelly arranged conductors may be set to three or more. Alternatively, the number of resonators that electromagnetically couple one of the two parallelly arranged conductors may be set to two, and the number of resonators that electromagnetically couple the other conductor may be set to one.

All examples and conditional language recited herein are intended for pedagogical purposes to aid the reader in understanding the invention and the concepts contributed by the inventor to furthering the art, and are to be construed as being without limitation to such specifically recited examples and conditions, nor does the organization of such examples in the specification relate to a showing of superiority and inferiority of the invention. Although the embodiments of the present invention have been described in detail, it should be understood that the various changes, substitutions, and alterations could be made hereto without departing from the spirit and scope of the invention.

What is claimed is:

1. A planar antenna comprising:

a substrate which is formed from a dielectric material;

a ground electrode which is provided on one surface of the substrate;

a first conductor which is provided on the other surface of the substrate, and which forms a microstrip line in combination with the ground electrode;

a second conductor which is provided on the other surface of the substrate so as to extend in parallel to the first conductor, and which forms a microstrip line in combination with the ground electrode;

a plurality of first resonators disposed between the first conductor and the second conductor which electromagnetically couple the first conductor at one longitudinal end of each of the first resonators to generate, with a current having a predetermined wavelength and flowing through the first conductor, electric fields which are in phase with each other; and at least one second resonator disposed between the first conductor and the second conductor which electromagnetically couples the second conductor at one longitudinal end of the at least one second resonator to generate, with a current having the predetermined wavelength and flowing through the second conductor, an electric field which is in phase with the electric fields generated by the plurality of first resonators, wherein the at least one second resonator is arranged alternately with the plurality of first resonators.

2. The planar antenna according to claim 1, wherein the plurality of first resonators is arranged so as to be spaced the predetermined wavelength apart along the first conductor, and the at least one second resonator is disposed at a position displaced away from the nearest one of the plurality of first resonators by one half of the predetermined wavelength along the second conductor.

3. The planar antenna according to claim 2, further comprising a third conductor for connecting one end of the first conductor to an end of the second conductor that is nearer to the one end, and wherein the first and the second conductors are fed at the other end of the first conductor, the other end of the second conductor is formed as an open end, and the distance from each of the plurality of first resonators to the at least one second resonator, measured along the first, second, and third conductors, is equal to the sum of an integral multiple of the predetermined wavelength and one half of the predetermined wavelength.

4. The planar antenna according to claim 2, wherein the first conductor and the second conductor have the same length, and the first conductor and the second conductor are each fed at one end on the same side so as to be in phase with the current having the predetermined wavelength.

5. The planar antenna according to claim 4, wherein the other ends of the first and second conductors are open ends, and wherein the plurality of first resonators is each located at a position spaced away along the first conductor from the other end of the first conductor by a distance equal to an integral multiple of the predetermined wavelength, and the at least one second resonator is located at a position spaced away along the second conductor from the other end of the second conductor by a distance equal to the sum of an integral multiple of the predetermined wavelength and one half of the predetermined wavelength.

6. The planar antenna according to claim 4, wherein the other ends of the first and second conductors are short-circuited to the ground electrode, and wherein the plurality of first resonators is each located at a position spaced away along the first conductor from the other end of the first conductor by a distance equal to the sum of an integral multiple of the predetermined wavelength and one quarter of the predetermined wavelength, and the at least one second resonator is located at a position spaced away along the second conductor from the other end of the second conductor by a distance equal to the sum of an integral multiple of the predetermined wavelength and three quarters of the predetermined wavelength.

7. The planar antenna according to claim 2, wherein the first conductor is longer than the second conductor by a value equal to the sum of an integral multiple of the predetermined wavelength and one half of the predetermined wavelength, the first conductor and the second conductor are each fed at one end on the same side so as to be 180 degrees out of phase with the current having the predetermined wavelength, and the other ends of the first and second conductors are located at the same position when viewed in a direction along the first conductor.

8. The planar antenna according to claim 1, wherein the plurality of first resonators is each disposed with a longitudinal direction thereof perpendicular to the first conductor, and the at least one second resonator is disposed with a longitudinal direction thereof perpendicular to the second conductor, and wherein the planar antenna further comprises:

a plurality of third resonators disposed in parallel to the first conductor which electromagnetically couple the first conductor to generate, with the current having the predetermined wavelength and flowing through the first conductor, electric fields which form circular polarization when combined with the electric fields generated by the plurality of first resonators; and at least one fourth resonator disposed in parallel to the second conductor which electromagnetically couples the second conductor to generate, with the current having the predetermined wavelength and flowing through the second conductor, an electric field which forms circular polarization when combined with the electric field generated by the at least one second resonator.

9. The planar antenna according to claim 1, wherein the plurality of first resonators and the at least one second resonator are each formed in the shape of a loop whose overall length is equal to the predetermined wavelength.

10. The planar antenna according to claim 1, wherein the plurality of first resonators and the at least one second resonator are each a dipole antenna whose overall length is equal to the predetermined wavelength or one half of the predetermined wavelength.

* * * * *